US010106353B2

(12) United States Patent
Ueda et al.

(10) Patent No.: US 10,106,353 B2
(45) Date of Patent: Oct. 23, 2018

(54) EDGE DETECTION DEVICE, IMAGE FORMING APPARATUS, AND EDGE DETECTION METHOD

(71) Applicants: Satoshi Ueda, Ibaraki (JP); Masumi Nakamura, Kanagawa (JP)

(72) Inventors: Satoshi Ueda, Ibaraki (JP); Masumi Nakamura, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 366 days.

(21) Appl. No.: 15/008,813

(22) Filed: Jan. 28, 2016

(65) Prior Publication Data

US 2016/0221778 A1 Aug. 4, 2016

(30) Foreign Application Priority Data

Jan. 29, 2015 (JP) ..... 2015-015389
Dec. 10, 2015 (JP) ..... 2015-241534

(51) Int. Cl.
*B65H 7/10* (2006.01)
*B65H 7/20* (2006.01)
(Continued)

(52) U.S. Cl.
CPC ..... *B65H 7/20* (2013.01); *B65H 7/10* (2013.01); *B65H 7/14* (2013.01); *B65H 9/002* (2013.01); *G03G 15/50* (2013.01); *B65H 2404/1424* (2013.01); *B65H 2511/10* (2013.01); *B65H 2511/222* (2013.01); *B65H 2511/242* (2013.01);
(Continued)

(58) Field of Classification Search
CPC ... B65H 7/02; B65H 7/14; B65H 7/10; B65H 7/20; B65H 9/20; B65H 2301/30; B65H 2511/514; B65H 2553/41; B65H 2553/414
See application file for complete search history.

(56) References Cited

U.S. PATENT DOCUMENTS

2013/0251434 A1 9/2013 Ueda et al.
2013/0307213 A1* 11/2013 Adachi ..... B65H 7/14 271/265.01
(Continued)

FOREIGN PATENT DOCUMENTS

JP 4794979 8/2011
JP 2016-088686 A 5/2016

*Primary Examiner* — Thomas A Morrison
(74) *Attorney, Agent, or Firm* — Harness, Dickey & Pierce, P.L.C.

(57) ABSTRACT

An edge detection device that detects an edge position in a width direction orthogonal to a conveying direction of a conveyance object, and includes: a photoelectric converter that is arranged in a conveyance path of the object and includes photoelectric conversion elements aligned along the width direction; a binarizer that binarizes an output from each of the photoelectric conversion elements by threshold comparison; a detector that detects a position of the photoelectric converter at which a binarized value is switched; a storage that stores therein a detection range as a range used for edge detection among the photoelectric conversion elements for each size of the object; and a determiner that reads out the detection range corresponding to the size of the object from the storage and determines a position detected by the detector within the detection range to be an edge position in the width direction of the object.

16 Claims, 7 Drawing Sheets

(51) Int. Cl.

| | |
|---|---|
| ***B65H 7/14*** | (2006.01) |
| ***B65H 9/00*** | (2006.01) |
| ***G03G 15/00*** | (2006.01) |

(52) U.S. Cl.

CPC .... *B65H 2551/27* (2013.01); *B65H 2553/414* (2013.01); *B65H 2553/822* (2013.01); *B65H 2701/1315* (2013.01); *B65H 2801/06* (2013.01); *G03G 2215/00721* (2013.01)

(56) References Cited

U.S. PATENT DOCUMENTS

| | | | |
|---|---|---|---|
| 2014/0029961 | A1 | 1/2014 | Ueda et al. |
| 2014/0037299 | A1 | 2/2014 | Nakura et al. |
| 2016/0124363 | A1 | 5/2016 | Takahashi |

* cited by examiner

EDGE DETECTION DEVICE, IMAGE FORMING APPARATUS, AND EDGE DETECTION METHOD

CROSS-REFERENCE TO RELATED APPLICATIONS

The present application claims priority to and incorporates by reference the entire contents of Japanese Patent Application No. 2015-015389 filed in Japan on Jan. 29, 2015 and Japanese Patent Application No. 2015-241534 filed in Japan on Dec. 10, 2015.

BACKGROUND OF THE INVENTION

1. Field of the Invention

The present invention relates to an edge detection device, an image forming apparatus, and an edge detection method.

2. Description of the Related Art

For example, in image forming apparatuses for forming an image on a conveyance object such as a recording sheet, misregistration in a width direction (a direction orthogonal to a conveying direction) of the conveyance object leads to misregistration of the image. To solve this problem, an edge position in the width direction of the conveyance object is detected, and a position at which the image is formed is adjusted corresponding to a misregistration amount (main scanning registration error) between the detected edge position and a reference position in design.

For example, Japanese Patent No. 4794979 discloses a technique in which a contact image sensor (CIS) is arranged in a conveyance path of the conveyance object, an output from each photoelectric conversion element included in the CIS is binarized, and the edge position in the width direction of the conveyance object is detected from a binarized digital signal. The photoelectric conversion elements in the CIS are arranged to be aligned along the width direction of the conveyance object, and outputs from the photoelectric conversion elements are significantly different between a position overlapping with the conveyance object and a position not overlapping with the conveyance object. Thus, the position of the photoelectric conversion element at which a value of the binarized digital signal is switched can be detected as the edge position in the width direction of the conveyance object.

However, for the edge detection device in the related art that detects the edge position in the width direction of the conveyance object using the CIS, it is not assumed to use a conveyance object with a hole such as a conveyance object with a punch hole and a conveyance object with holes at some spots. Accordingly, when a conveyance object with a hole is being conveyed, an edge portion of the hole may be erroneously detected as the edge position in the width direction of the conveyance object, that is, detection accuracy for the edge position is insufficient.

SUMMARY OF THE INVENTION

It is an object of the present invention to at least partially solve the problems in the conventional technology.

According to exemplary embodiments of the present invention, there is provided an edge detection device that detects an edge position in a width direction orthogonal to a conveying direction of a conveyance object, the edge detection device comprising: a photoelectric conversion module that is arranged in a conveyance path of the conveyance object and includes a plurality of photoelectric conversion elements aligned along the width direction; a binarization module that binarizes an output from each of the photoelectric conversion elements by threshold comparison; a detection module that detects a position of the photoelectric conversion element at which a binarized value is switched; a storage that stores therein a detection range as a range used for edge detection among the photoelectric conversion elements for each size of the conveyance object; and a determination module that reads out the detection range corresponding to the size of the conveyance object from the storage and determines a position detected by the detection module within the detection range to be an edge position in the width direction of the conveyance object.

Exemplary embodiments of the present invention also provide an image forming apparatus comprising the above-described edge detection device.

Exemplary embodiments of the present invention also provide an edge detection method executed by an edge detection device that detects an edge position in a width direction orthogonal to a conveying direction of a conveyance object, the edge detection device including: a photoelectric conversion module that is arranged in a conveyance path of the conveyance object and includes a plurality of photoelectric conversion elements aligned along the width direction; and a storage that stores therein a detection range as a range used for edge detection among the photoelectric conversion elements for each size of the conveyance object, the edge detection method comprising: binarizing an output from each of the photoelectric conversion elements by threshold comparison; detecting a position of the photoelectric conversion element at which a binarized value is switched; and reading out the detection range corresponding to a size of the conveyance object from the storage, and determining the position detected at the detecting within the detection range to be the edge position in the width direction of the conveyance object.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an edge detection device, an image forming apparatus, and an edge detection method according to an embodiment of the present invention in detail with reference to the attached drawings. In the following embodiment, described is a tandem image forming apparatus that forms a full-color image using an electrophotographic system as an example of the image forming apparatus to which the present invention is applied, but the image forming apparatus is not limited thereto.

Figure 1:
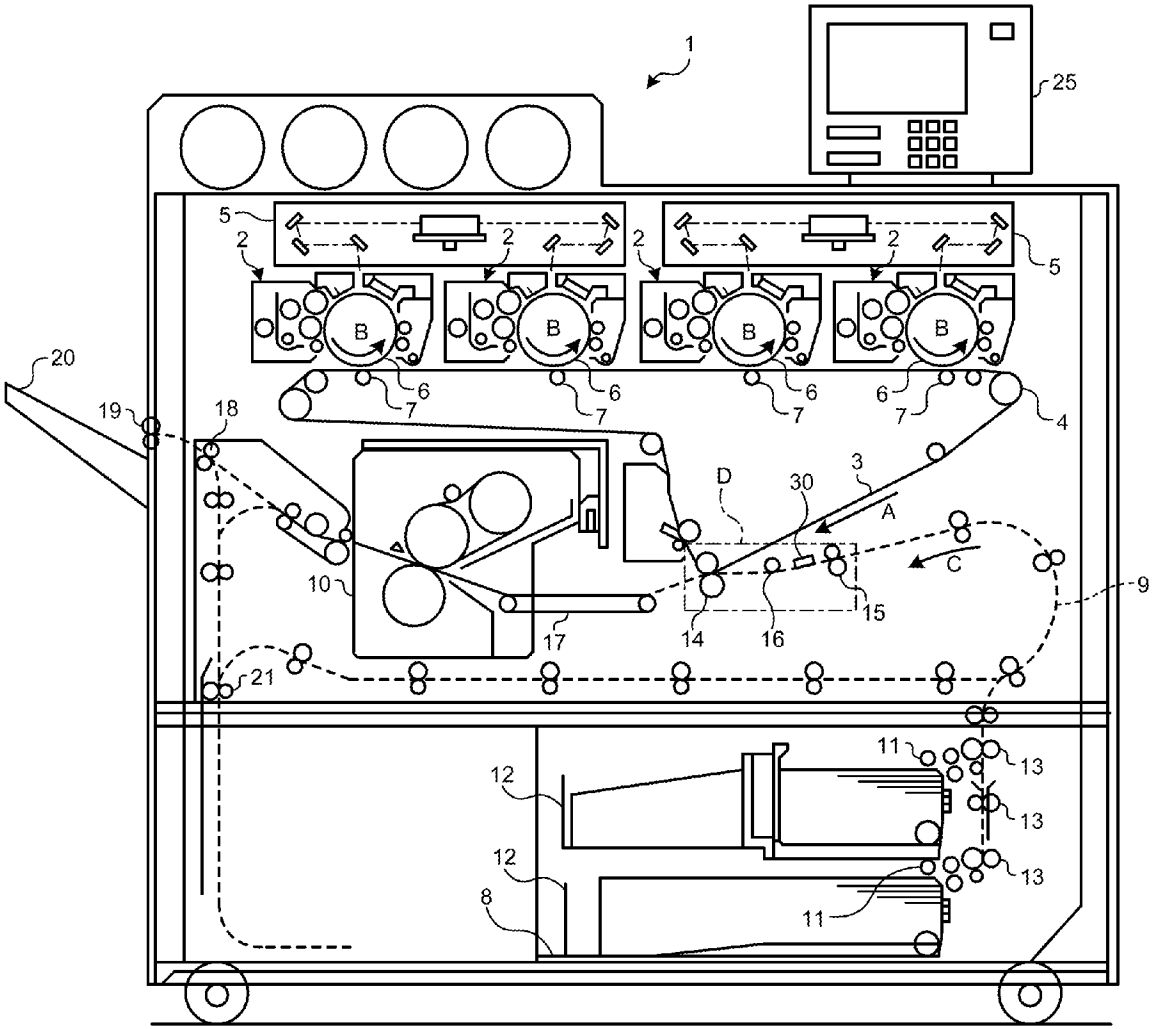
FIG. 1 is a diagram illustrating a mechanical configuration example of an image forming apparatus according to an embodiment of the present invention.
Figure 2:
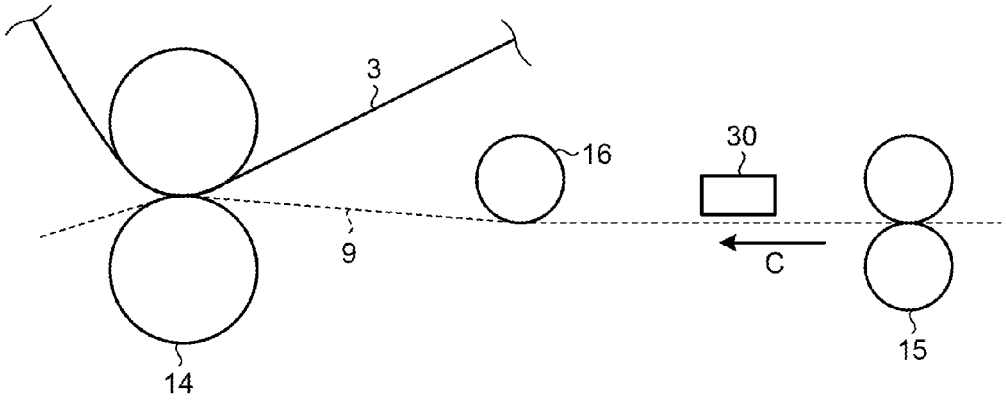
FIG. 2 is an enlarged view of the D part in FIG. 1.

FIG. 1 is a diagram illustrating a mechanical configuration example of an image forming apparatus 1 according to the embodiment. FIG. 2 is an enlarged view of the D part in FIG. 1. As illustrated in FIG. 1, the image forming apparatus 1 includes four image formation units 2 corresponding to respective colors of Y (yellow), M (magenta), C (cyan), and Bk (black). The four image formation units 2 have the same internal structure except a color of a toner image to be formed. The four image formation units 2 are arranged along an intermediate transfer belt 3 serving as an intermediate transfer body.

The intermediate transfer belt 3 is configured as an endless belt that is driven by a driving roller 4 and circulates in the arrow A direction in FIG. 1. The four image formation units 2 are arranged to be aligned, for example, in order of Y, M, C, and Bk from an upstream side to a downstream side along a moving direction of the intermediate transfer belt 3. An exposure unit 5 is arranged on the opposite side of the intermediate transfer belt 3 across the four image formation units 2.

The image formation unit 2 includes a photoconductor drum 6 that rotates in the arrow B direction in FIG. 1 at a constant peripheral speed. A charging device, a developing device, a static eliminator, a cleaner, and the like are arranged around the photoconductor drum 6. A primary transfer roller 7 is arranged at a position opposed to the photoconductor drum 6 across the intermediate transfer belt 3.

In forming an image, an outer peripheral surface of the photoconductor drum 6 is uniformly charged by the charging device in the dark, and exposed by writing light from the exposure unit 5 that is modulated corresponding to image data. Due to this, an electrostatic latent image corresponding to the image data is formed on the photoconductor drum 6. When the electrostatic latent image is developed by the developing device, a toner image is formed on the photoconductor drum 6. The toner image is transferred onto the intermediate transfer belt 3 by working of the primary transfer roller 7 at a primary transfer position at which the photoconductor drum 6 is brought into contact with the intermediate transfer belt 3. After the toner image is completely transferred, unnecessary residual toner on the outer peripheral surface of the photoconductor drum 6 is wiped away by the cleaner, and static electricity is eliminated from the photoconductor drum 6 by the static eliminator.

In the image forming apparatus 1 according to the embodiment, the operations described above are sequentially performed by each of the image formation units 2 of Y, M, C, and Bk in accordance with the circulation of the intermediate transfer belt 3. As a result, a full-color toner image obtained by overlapping the four colors is formed on the intermediate transfer belt 3.

The image forming apparatus 1 also includes a sheet feeding table 8 for feeding an conveyance object, a conveyance path 9 for conveying the conveyance object (a path represented by a dashed line in FIG. 1), and a fixing device 10 for fixing the toner image onto the conveyance object.

The sheet feeding table 8 sends out the conveyance object one by one from one of a plurality of sheet feeding trays 12 storing the conveyance object by selectively rotating a sheet feeding roller 11. The conveyance object is conveyed in the arrow C direction in FIG. 1 along the conveyance path 9 by a conveyance roller 13, and abuts on a registration roller 15 to be in a standby state on an upstream side of a secondary transfer position at which a secondary transfer roller 14 is arranged. The conveyance object in a standby state is conveyed to the secondary transfer position due to rotation of the registration roller 15 in accordance with a timing when the full-color toner image formed on the intermediate transfer belt 3 reaches the secondary transfer position.

As illustrated in FIG. 2 as the enlarged view, a contact image sensor (CIS) 30 serving as a photoelectric conversion module and a shift roller 16 that shifts the conveyance object in a width direction (main scanning direction) are arranged in the conveyance path 9 between the registration roller 15 and the secondary transfer position. When the conveyance object conveyed to the secondary transfer position due to the rotation of the registration roller 15 passes through the position of the CIS 30, an edge position thereof in the width direction is detected. The shift roller 16 is then driven and controlled based on a shift amount between the detected edge position in the width direction and a reference position in design, and the conveyance object is shifted in the width direction by the shift roller 16. This mechanism adjusts the position in the width direction of the conveyance object that reaches the secondary transfer position. When the conveyance object the position in the width direction of which is adjusted reaches the secondary transfer position, the full-color toner image on the intermediate transfer belt 3 is transferred onto the conveyance object by working of the secondary transfer roller 14. That is, the position at which the image is formed on the conveyance object is adjusted corresponding to the detected edge position in the width direction of the conveyance object.

The conveyance object onto which the toner image is transferred is conveyed to the fixing device 10 by a conveyance belt 17 arranged in the conveyance path 9. Heat and a pressure are applied by the fixing device 10 to the conveyance object conveyed to the fixing device 10 to fix the toner image.

In a case of performing single-side printing, after the toner image is fixed onto the surface of the conveyance object by the fixing device 10, the conveyance object is led to an ejection port by an ejection roller 18, curl of the conveyance object is straightened by passing through a decurler roller 19, and the conveyance object is ejected onto an ejection tray 20. In a case of performing reverse paper ejection or double-side printing, after the toner image is fixed onto the surface of the conveyance object by the fixing device 10, the conveyance object passes through a reverse path of the conveyance path 9 to be once drawn in by a reverse roller 21, and is sent out in a reversed state due to reversal of the reverse roller 21. In a case of performing reverse paper ejection, the reversed conveyance object is led to the ejection port by the ejection roller 18, curl of the conveyance object is straightened by passing through the decurler roller 19, and the conveyance object is ejected onto the ejection tray 20. In a case of performing double-side printing, the reversed conveyance object passes through a cyclic path of the conveyance path 9 to be conveyed to a position at which the conveyance object abuts on the registration roller 15. Subsequently, after the toner image is transferred and fixed onto the back surface of the conveyance object through a similar procedure, the conveyance object is led to the ejection port by the ejection roller 18, curl of the conveyance object is straightened by passing through the decurler roller 19, and the conveyance object is ejected onto the ejection tray 20.

The image forming apparatus 1 according to the embodiment includes an operator panel 25 serving as a user interface. The operator panel 25 includes a display unit that displays various pieces of information, various operation keys and a touch panel for receiving an operation made by an operator, and the like arranged therein. Through the operator panel 25, the image forming apparatus 1 presents various pieces of information to the operator, and the operator inputs various settings to the image forming apparatus 1.

Figure 3:
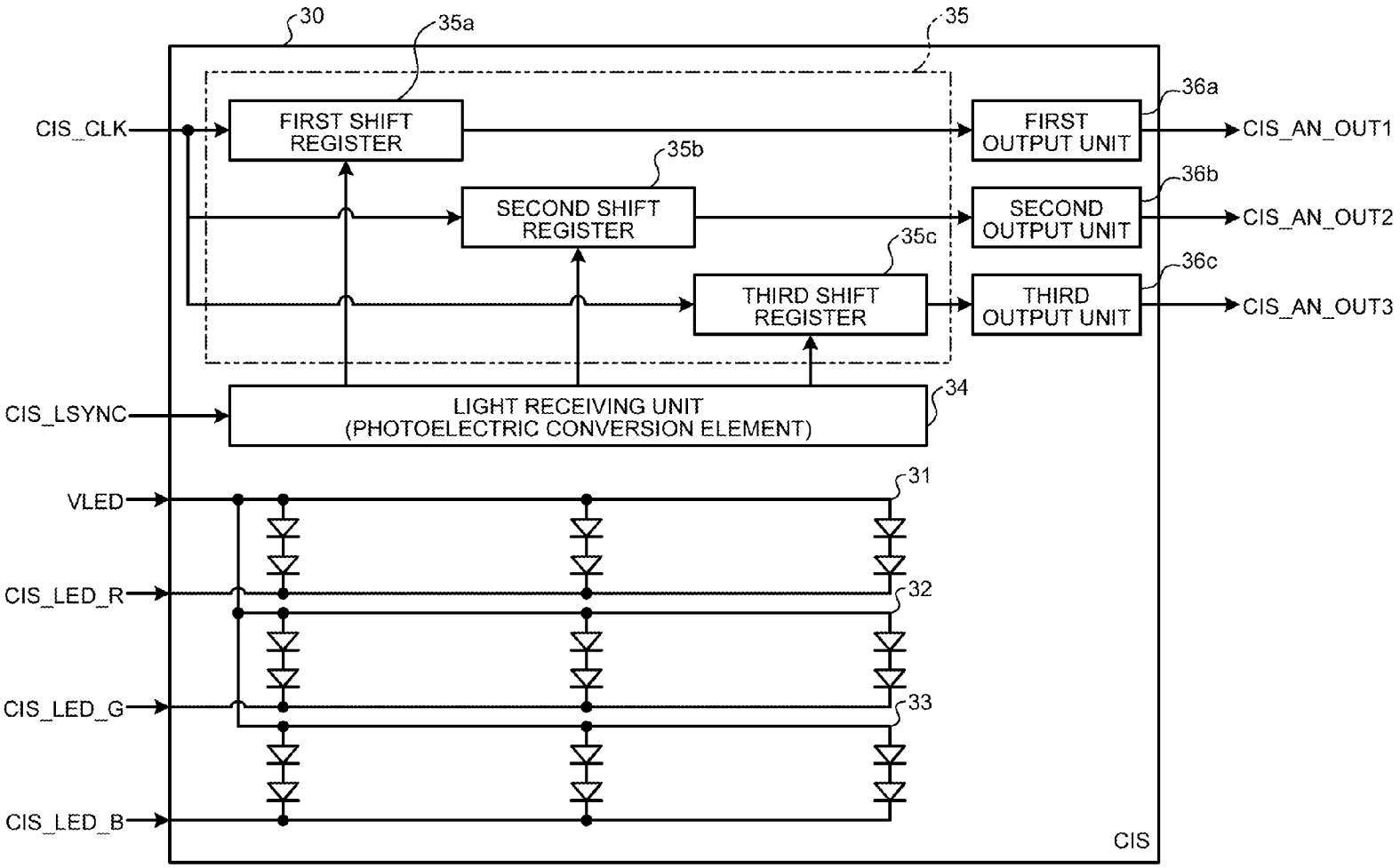
FIG. 3 is a schematic configuration diagram illustrating a configuration example of a contact image sensor (CIS)

The following describes details about the CIS 30 arranged in the conveyance path 9 between the registration roller 15 and the secondary transfer position with reference to FIG. 3. The CIS 30 is a sensor that emits light toward the conveyance object passing through the position of the CIS 30, receives reflected light reflected by the conveyance object, and outputs a signal corresponding to received light quantity. FIG. 3 is a schematic configuration diagram illustrating a configuration example of the CIS 30. As an example of the CIS 30, the following describes a configuration of dividing a signal from the light receiving unit 34 into three parts to be output. However, the CIS 30 included in the image forming apparatus 1 according to the embodiment is not limited thereto.

As illustrated in FIG. 3, the CIS 30 includes light source units 31, 32, and 33, the light receiving unit 34, and a shift register unit 35. The light receiving unit 34 includes a large number of photoelectric conversion elements (hereinafter, each of the photoelectric conversion elements may also be referred to as a "pixel") arranged in a line along the width direction of the conveyance object passing through the conveyance path 9. The shift register unit 35 includes a first shift register 35*a*, a second shift register 35*b*, and a third shift register 35*c* corresponding to respective pixel groups (groups of the photoelectric conversion elements) of the light receiving unit 34 that are divided into three parts.

Each of the light source units 31, 32, and 33 emits light when an electric current flows through a light emitting diode (LED) by being driven by each of a CIS_LED_R signal, a CIS_LED_G signal, and a CIS_LED_B signal. When each of the light source unit 31 including a red LED, the light source unit 32 including a green LED, and the light source unit 33 including a blue LED emits light, white light can be emitted to the conveyance object.

The light from the light source units 31, 32, and 33 is reflected at a position where the conveyance object is present, and received by a corresponding pixel (photoelectric conversion element) of the light receiving unit 34. Reflection is not caused (or a reflected light quantity is extremely small) at a position where the conveyance object is not present, so that the light is not received (or a received light quantity is extremely small) by a pixel (photoelectric conversion element) of the light receiving unit 34 corresponding to the position where the conveyance object is not present.

During one cycle of a CIS_LSYNC signal, the light receiving unit 34 accumulates light with each pixel (photoelectric conversion element), and stores a voltage corresponding to a quantity of accumulated light in the shift register unit 35 as a pixel signal when the CIS_LSYNC signal is asserted. In this case, the pixel group (group of the photoelectric conversion elements) of the light receiving unit 34 is divided into three parts, that is, a first pixel group, a second pixel group, and a third pixel group. A pixel signal of the first pixel group is stored in the first shift register 35*a*, a pixel signal of the second pixel group is stored in the second shift register 35*b*, and a pixel signal of the third pixel group is stored in the third shift register 35*c*. The light accumulated by each pixel (photoelectric conversion element) of the light receiving unit 34 is reset when a pixel signal is stored in the shift register unit 35. After being reset, each pixel of the light receiving unit 34 starts to accumulate the light again.

The shift register unit 35 sends out, in synchronization with a CIS_CLK signal, each of the pixel signals stored in the first shift register 35*a*, the second shift register 35*b*, and the third shift register 35*c* one by one as an analog signal from each of the shift registers 35*a*, 35*b*, and 35*c*. The pixel signal from the first shift register 35*a* is output as a CIS_AN_OUT1 signal from a first output unit 36*a* to the outside of the CIS 30. The pixel signal from the second shift register 35*b* is output as a CIS_AN_OUT2 signal from a second output unit 36*b* to the outside of the CIS 30. The pixel signal from the third shift register 35*c* is output as a CIS_AN_OUT3 signal from a third output unit 36*c* to the outside of the CIS 30. The CIS 30 having a configuration in which the signal of the light receiving unit 34 is divided into three parts to be output has been described above. A CIS having a configuration in which the signal is output without being divided has the same configuration as the example described above except that one shift register and one output unit are provided.

Figure 4:
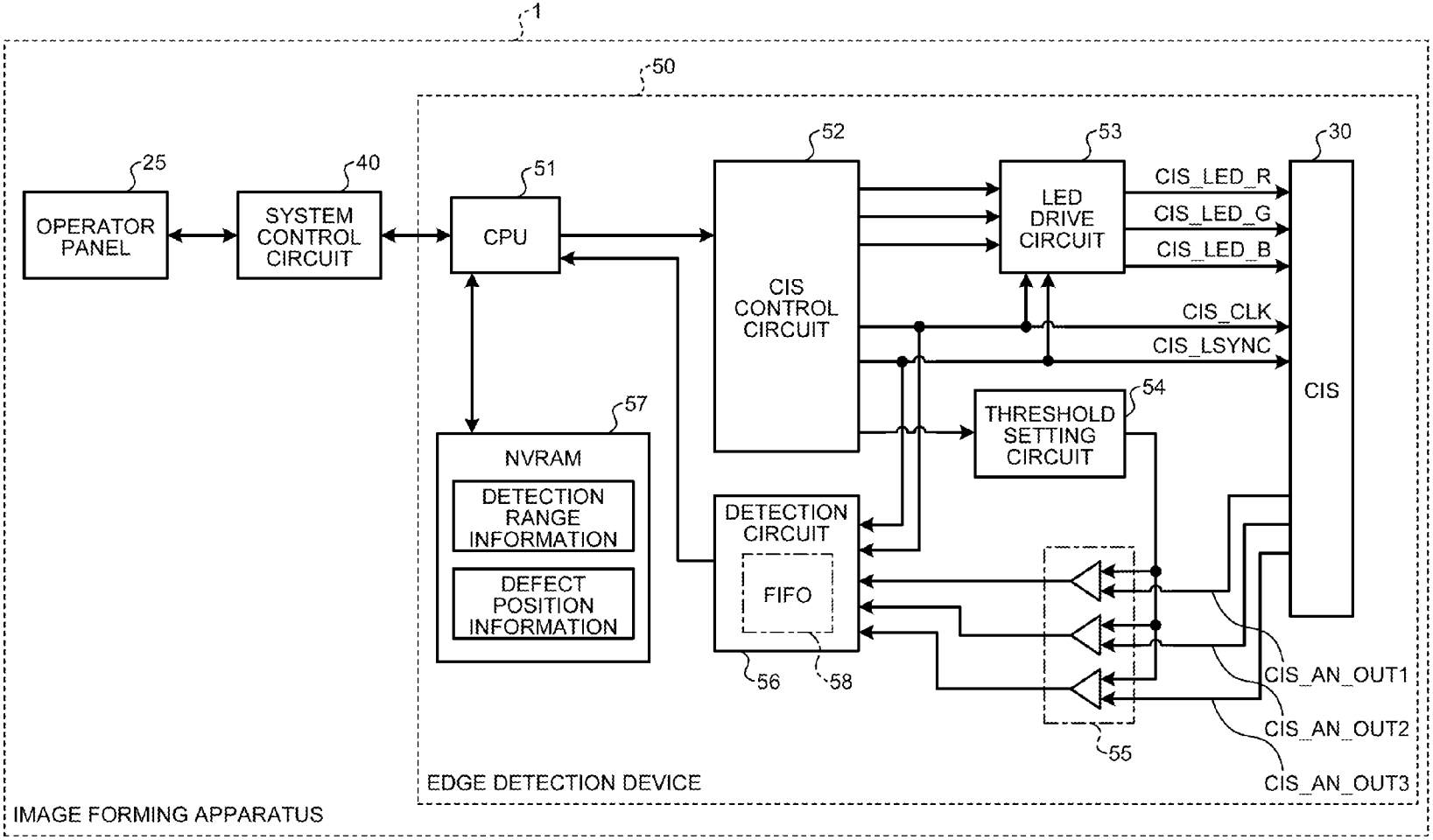
FIG. 4 is a block diagram illustrating a configuration example of an edge detection device according to the embodiment.

The image forming apparatus 1 according to the embodiment includes an edge detection device that detects, using the CIS 30 configured as described above, the edge position in the width direction of the conveyance object conveyed from the registration roller 15 to the secondary transfer position. The following describes a specific example of the edge detection device with reference to FIG. 4. FIG. 4 is a block diagram illustrating a configuration example of an edge detection device 50 according to the embodiment.

As illustrated in FIG. 4, the edge detection device 50 includes a CPU 51 (determination module, warning module), a CIS control circuit 52, an LED drive circuit 53, the CIS 30 (photoelectric conversion module), a threshold setting circuit 54, a comparator 55 (binarization module), a detection circuit 56 (detection module), and a non-volatile RAM (NVRAM) 57 (storage). The CPU 51 is connected to the system control circuit 40 of the image forming apparatus 1. The CPU 51 is also connected to the operator panel 25 of the image forming apparatus 1 via the system control circuit 40.

The CPU 51 integrally controls the entire operation of the edge detection device 50. The CPU 51 may perform another control related to the image forming apparatus 1 at the same time as a main CPU of the image forming apparatus 1. In other words, the CPU 51 that controls the operation of the edge detection device 50 may be implemented as part of the functions of the main CPU of the image forming apparatus 1.

When the image forming apparatus 1 starts to perform an image forming operation (printing) on the conveyance object, the CPU 51 sets various settings on the CIS control circuit 52 for reading out a signal from the CIS 30.

In accordance with the setting set by the CPU 51, the CIS control circuit 52 sends out, to the CIS 30, a reference clock CIS_CLK signal for reading out a signal from the CIS 30 and the CIS_LSYNC signal for determining a charge accumulation time for the CIS 30. To set a value of the electric current to be flowed through each LED in the light source units 31, 32, and 33 of the CIS 30, the CIS control circuit 52 sends out a PWM signal to the LED drive circuit 53. To generate a comparative reference voltage for binarizing analog signals (the CIS_AN_OUT1 signal, the CIS_AN_OUT2 signal, and the CIS_AN_OUT3 signal) from the CIS 30 with the comparator 55, the CIS control circuit 52 sends out the PWM signal to the threshold setting circuit 54.

The LED drive circuit 53 generates a DC voltage corresponding to the PWM signal from the CIS control circuit 52, and causes the DC voltage to be a reference voltage of the electric current to be flowed through each LED of the light source units 31, 32, and 33 of the CIS 30. The threshold setting circuit 54 generates a DC voltage corresponding to the PWM signal from the CIS control circuit 52, and causes the DC voltage to be the comparative reference voltage (threshold voltage) for the comparator 55.

After the above processing is ended, a timing when the conveyance object in a standby state at the registration roller 15 is being conveyed toward the secondary transfer position (hereinafter, referred to as an "edge detection timing") is reached, the CPU 51 instructs the CIS control circuit 52 to start edge detection. When receiving the instruction to start edge detection from the CPU 51, in synchronization with the CIS_LSYNC signal, the CIS control circuit 52 sends out, to the LED drive circuit 53, a control signal for lighting the light source units 31, 32, and 33 of the CIS 30. In response to the control signal from the CIS control circuit 52, the LED drive circuit 53 lights the light source units 31, 32, and 33 of the CIS 30 for a certain period of time. The light source units 31, 32, and 33 are lit multiple times in accordance with the instruction from the CPU 51.

The CIS 30 outputs, for each pixel, a voltage corresponding to a quantity of light that is accumulated by each pixel (photoelectric conversion element) of the pixel group of the light receiving unit 34 during the light source units 31, 32, and 33 are lit as the CIS_AN_OUT1 signal, the CIS_AN_OUT2 signal, and the CIS_AN_OUT3 signal using the CIS_LSYNC signal and the CIS_CLK signal. Each of the CIS_AN_OUT1 signal, the CIS_AN_OUT2 signal, and the CIS_AN_OUT3 signal output from the CIS 30 is compared with the comparative reference voltage (threshold voltage) from the threshold setting circuit 54 to be binarized in the comparator 55, and is input to the detection circuit 56 as a digital signal.

The detection circuit 56 sequentially checks a value of 0/1 of a binarized digital signal for each pixel with the comparator 55 for each of the CIS_AN_OUT1 signal, the CIS_AN_OUT2 signal, and the CIS_AN_OUT3 signal output from the CIS 30. The detection circuit 56 then detects a position of the pixel (the position of the photoelectric conversion element) at which the value of the digital signal is switched from 0 to 1, or from 1 to 0.

For example, when each of the CIS_AN_OUT1 signal corresponding to the first pixel group, the CIS_AN_OUT2 signal corresponding to the second pixel group, and the CIS_AN_OUT3 signal corresponding to the third pixel group, each group being obtained by dividing the pixel group of the light receiving unit 34 of the CIS 30 into three parts, is binarized by the comparator 55 and input as the digital signal, the detection circuit 56 stores each digital signal in a FIFO (first in, first out) 58. The detection circuit 56 reads the CIS_CLK signal and the CIS_LSYNC signal output from the CIS control circuit 52 to count the CIS_CLK signal, and every time the CIS_CLK signal is counted up, the detection circuit 56 sequentially takes out the digital signal of each of the first pixel group, the second pixel group, and the third pixel group from the FIFO 58 for each pixel, and checks the value of 0/1. The detection circuit 56 detects the position of the pixel (position of the photoelectric conversion element) at which the value of 0/1 is switched for each of the first pixel group, the second pixel group, and the third pixel group from a count value of the CIS_CLK signal at the time when the value of 0/1 is switched, and notifies the CPU 51 of the position. The detection circuit 56 repeats the above processing for each cycle of the CIS_LSYNC signal.

When the position of the pixel at which the value of the digital signal is switched is detected by the detection circuit 56, the CPU 51 determines the position of the pixel detected by the detection circuit 56 while referring to information stored in the NVRAM 57.

The NVRAM 57 stores detection range information. The detection range information is information that defines, for each size of the conveyance object, a detection range as a range of pixels used for detecting the edge position in the width direction of the conveyance object among the pixels (photoelectric conversion elements) included in the light receiving unit 34 of the CIS 30. The detection range is a pixel range having a predetermined size centered around a reference position that is a pixel position at the time when the edge in the width direction of the conveyance object conveyed along the conveyance path 9 passes through the light receiving unit 34 of the CIS 30 in design, the pixel range being defined considering a set error of the conveyance object on the sheet feeding tray 12 or unevenness such as skew in conveyance with respect to the width direction of the conveyance object. The reference position of the conveyance object varies depending on the size of the conveyance object, so that the detection range is defined in advance for each size of the conveyance object and stored in the NVRAM 57 as the detection range information.

In the image forming apparatus 1 according to the embodiment, the size of the conveyance object stored in each sheet feeding tray 12 of the sheet feeding table 8 is, for example, detected and stored by a size detecting sensor when the conveyance object is set in the sheet feeding tray 12. When the image forming operation (printing) on the conveyance object is started, the CPU 51 can recognize the size of the conveyance object used for image formation based on information on the selected sheet feeding tray 12. When recognizing the size of the conveyance object used for image formation, the CPU 51 reads out a detection range corresponding to the size of this conveyance object from among pieces of detection range information stored in the NVRAM 57, and sets the detection range as a detection range used for edge detection. Thereafter, when the edge detection timing is reached, the CPU 51 instructs the CIS control circuit 52 to start edge detection as described above. When the position of the pixel at which the value of the digital signal is switched is detected by the detection circuit 56, the CPU 51 checks whether the position of the pixel detected by the detection circuit 56 is within the detection range read out from the NVRAM 57 to be set. If the position of the pixel is within the detection range, the CPU 51 determines the position to be the edge position in the width direction of the conveyance object.

Figure 5:
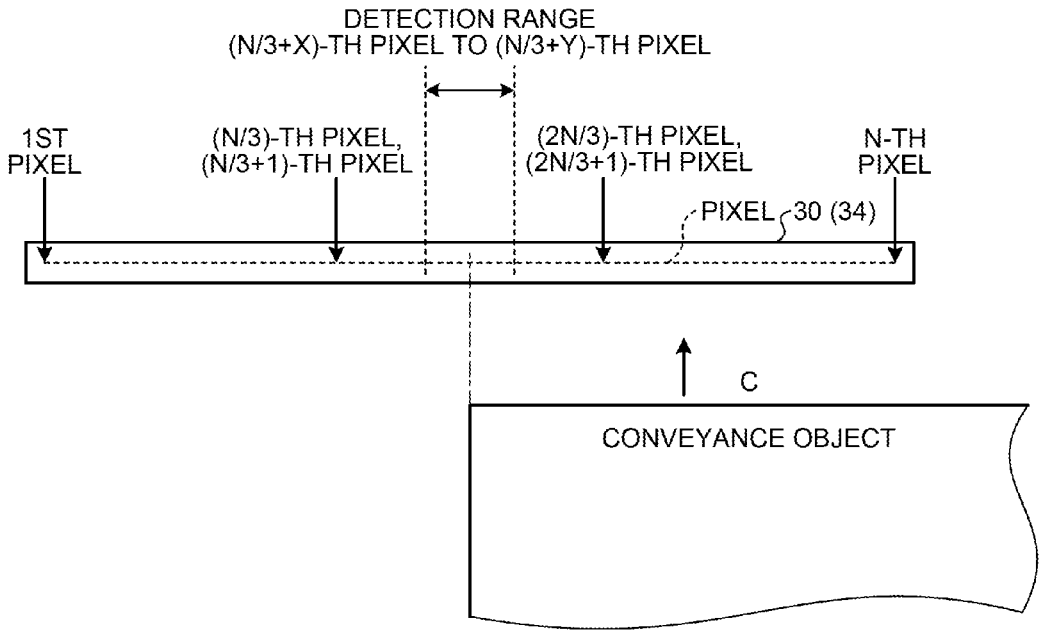
FIG. 5 is a diagram for explaining an example of a detection range.

FIG. 5 is a diagram for explaining an example of the detection range. In the example illustrated in FIG. 5, the number of pixels is N in the light receiving unit 34 of the CIS 30, and the pixels are divided into three parts, that is, the first pixel group: 1st pixel to (N/3)-th pixel, the second pixel group: (N/3+1)-th pixel to (2N/3)-th pixel, and the third pixel group: (2N/3+1)-th pixel to N-th pixel. A range from the (N/3+X)-th pixel to the (N/3+Y)-th pixel in the second pixel group is the detection range corresponding to the size of the conveyance object. In this case, the CPU 51 determines the position of the pixel detected by the detection circuit 56 in the range from the (N/3+X)-th pixel to the (N/3+Y)-th pixel to be the edge position in the width direction of the conveyance object.

In this way, in the edge detection device 50 according to the embodiment, the CPU 51 sets the detection range corresponding to the size of the conveyance object, and determines the position of the pixel detected by the detection circuit 56 in the detection range to be the edge position in the width direction of the conveyance object. This configuration can effectively prevent, when the conveyance object with a hole is being conveyed for example, an edge portion of the hole from being erroneously detected as the edge position in the width direction. As a result, the edge position in the width direction of the conveyance object used for image formation can be detected with high accuracy.

In the above description, the CPU 51 reads out the detection range corresponding to the size of the conveyance object from the NVRAM 57, and determines the position of the pixel detected by the detection circuit 56 in the detection range to be the edge position in the width direction of the conveyance object. However, when the operator performs an operation and the operator panel 25 has received the operation made by the operator for setting the detection range, the CPU 51 may determine the position of the pixel detected within the detection range that is set in response to the operation made by the operator to be the edge position in the width direction of the conveyance object.

In this case, for example, the CPU 51 reads out the detection range corresponding to the size of the conveyance object from the NVRAM 57 to notify the system control circuit 40 of the detection range, and instructs the system control circuit 40 to perform display control of the operator panel 25. The system control circuit 40 explicitly indicates the detection range corresponding to the size of the conveyance object in accordance with the instruction from the CPU 51, and causes the operator panel 25 to display a screen for receiving an operation of changing the detection range. When the operator performs the operation of changing the detection range on the screen displayed on the operator panel 25, operation information on the operator is notified to the CPU 51 via the system control circuit 40. The CPU 51 sets the detection range based on the operation information on the operator, and determines the position of the pixel detected by the detection circuit 56 within the detection range to be the edge position in the width direction of the conveyance object.

When the size of the conveyance object cannot be recognized, for example, when a custom-sized conveyance object that is manually fed is used for image formation, the CPU 51 instructs the system control circuit 40 to control display of the operator panel 25 without notifying the system control circuit 40 of the detection range. In this case, in accordance with the instruction from the CPU 51, the system control circuit 40 causes the operator panel 25 to display the screen for receiving an operation of setting the detection range as required. When the operator performs the operation of setting the detection range as required on the screen displayed on the operator panel 25, the operation information on the operator is notified to the CPU 51 via the system control circuit 40. The CPU 51 sets the detection range based on the operation information on the operator, and determines the position of the pixel detected by the detection circuit 56 within the detection range to be the edge position in the width direction of the conveyance object.

As described above, with the configuration in which, when the operator performs the operation of setting the detection range, the detection range is set in response to the operation, an appropriate detection range can be set in response to the operation made by the operator even when the position of the hole of the conveyance object is close to the edge in the width direction and may be overlapped with a default detection range, or when a custom-sized conveyance object the size of which cannot be specified is being conveyed, for example. As a result, the edge position in the width direction of the conveyance object used for image formation can be detected with higher accuracy.

The edge position in the width direction of the conveyance object determined by the CPU 51 is transmitted to the system control circuit 40 as an edge detection result obtained by the edge detection device 50 according to the embodiment. The system control circuit 40 calculates a shift amount between the edge position detected by the edge detection device 50 and the reference position, and drives the shift roller 16 corresponding to the shift amount to shift the conveyance object conveyed toward the secondary transfer position in the width direction. Accordingly, the position in the width direction of the conveyance object that reaches the secondary transfer position is adjusted, and the position at which the image is formed on the conveyance object is adjusted. Fine adjustment of the image forming position on the conveyance object can be also performed by adjusting a position at which the writing light from the exposure unit 5 is emitted to the photoconductor drum 6, that is, a position at which the electrostatic latent image is formed on the photoconductor drum 6.

In the edge detection device 50 according to the embodiment, the detection circuit 56 described above detects the position of the pixel at which the value of the binarized digital signal is switched by the comparator 55 even outside the detection range that is set corresponding to the size of the conveyance object. For example, in the example illustrated in FIG. 5, the detection range corresponding to the size of the conveyance object is a range from the (N/3+X)-th pixel to the (N/3+Y)-th pixel in the second pixel group, but the detection circuit 56 detects the position of the pixel at which the value of the digital signal is switched for each of the first pixel group, the second pixel group, and the third pixel group. The position of the pixel detected by the detection circuit 56 outside the detection range is assumed to represent the fact that the value of the digital signal is switched because a foreign substance such as dirt or dust adheres to the CIS 30.

Thus, when the position of the pixel detected by the detection circuit 56 is outside the detection range that is set corresponding to the size of the conveyance object (or in response to the operation made by the operator), the CPU 51 determines the position to be a defect position to which a foreign substance adheres. The CPU 51 then stores information on the pixel position determined to be the defect position in the NVRAM 57 as defect position information. The defect position information stored in the NVRAM 57 can be utilized as useful information, for example, for determining whether the defect position is included within a newly set detection range when the size of the conveyance object is switched and the detection range is changed. That is, when the detection range includes the defect position, the defect position may be erroneously detected as the edge position in the width direction of the conveyance object. In such a case, by outputting a warning to the operator to urge the operator to clean the CIS 30, the defect position can be removed and accuracy in edge detection can be improved.

To address such a case, in setting the detection range corresponding to the size of the conveyance object (or in response to the operation made by the operator), the CPU 51 checks whether the detection range includes the defect position stored in the NVRAM 57. If the detection range includes the defect position, the CPU 51 performs control for outputting a warning to the operator. Specifically, when the detection range includes the defect position, the CPU 51 instructs the system control circuit 40 to perform display control, for example, for causing the operator panel 25 to display a warning screen including a message for urging the operator to clean the CIS 30. In accordance with the instruction from the CPU 51, the system control circuit 40 causes the operator panel 25 to display the warning screen including the message for urging the operator to clean the CIS 30. Due to this, the operator can recognize that a foreign substance adheres to the CIS 30 by referring to the warning screen on the operator panel 25, and can take appropriate countermeasures such as the cleaning of the CIS 30.

In the above description, when the position of the pixel detected by the detection circuit 56 is outside the detection range, the CPU 51 determines the position of the pixel to be the defect position. However, the CPU 51 may be configured to determine, when the position of the pixel detected by the detection circuit 56 is outside the detection range and the conveyance object does not pass through that position, the position of the pixel to be the defect position. For example, in the example illustrated in FIG. 5, the (N/3+Y+1)-th pixel to the (2N/3)-th pixel in the second pixel group and the pixels in the third pixel group are outside the detection range that is set corresponding to the size of the conveyance object, but these pixels are present at positions through which the conveyance object passes. Thus, excluding the above-mentioned pixels, the CPU 51 determines the defect position based on the pixels in the first pixel group and the (N/3+1)-th pixel to the (N/3+X−1)-th pixel in the second pixel group. That is, when the position of the pixel detected by the detection circuit 56 is included in the first pixel group or a range from the (N/3+1)-th pixel to (N/3+X−1)-th pixel in the second pixel group, the CPU 51 determines the position of the pixel to be the defect position. This configuration can effectively prevent, for example, the edge portion of the hole of the conveyance object from being erroneously determined to be the defect position.

Figure 6:
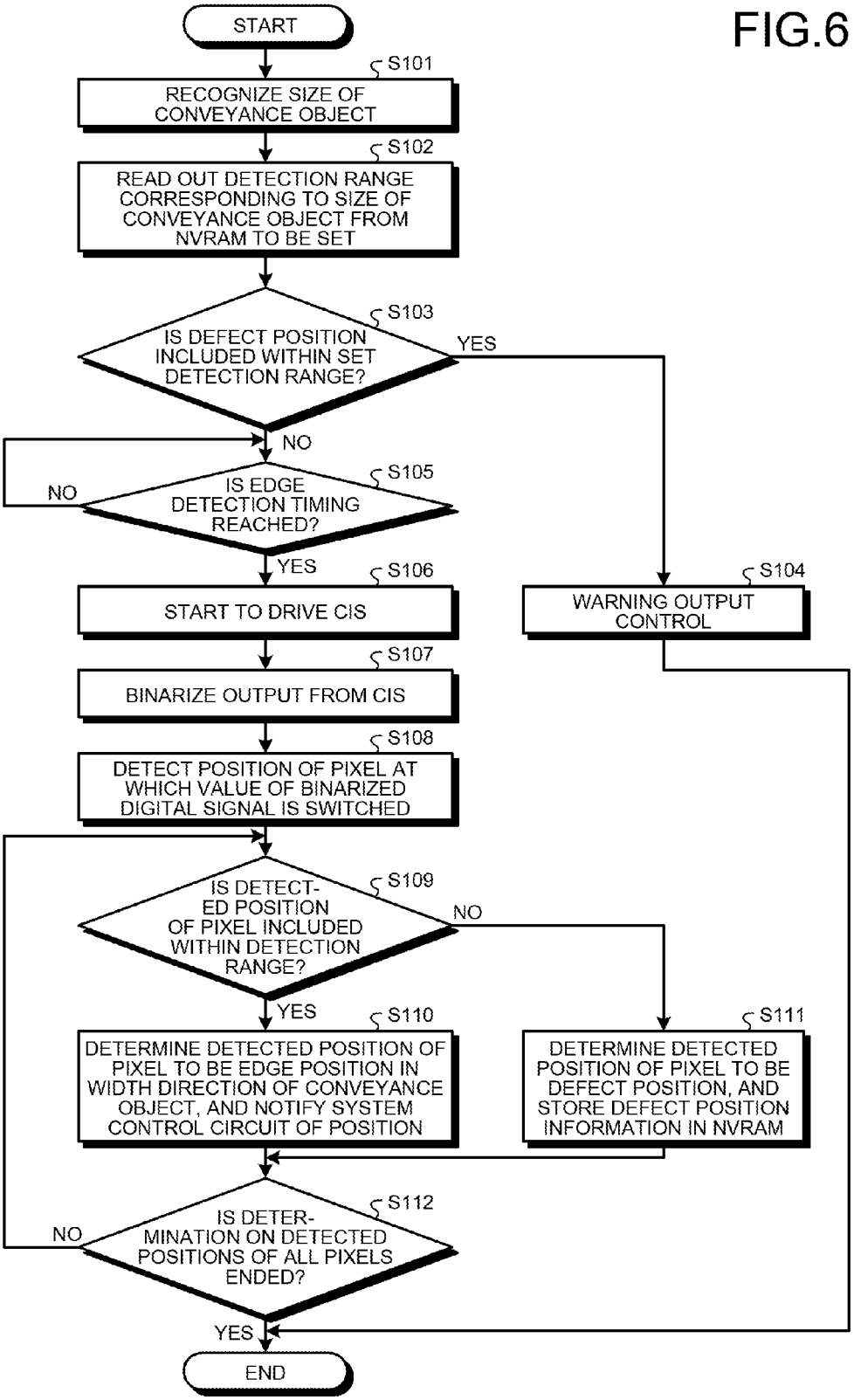
FIG. 6 is a flowchart for explaining a processing procedure performed by the edge detection device according to the embodiment.

Next, the following describes an operation example of the edge detection device 50 according to the embodiment with reference to FIG. 6. FIG. 6 is a flowchart for explaining a processing procedure performed by the edge detection device 50 according to the embodiment.

When the image forming apparatus 1 starts to perform image forming operation, first, the CPU 51 recognizes the size of the conveyance object based on the information on the sheet feeding tray 12 that is selected as a tray for feeding the conveyance object used for image formation (Step S101). The CPU 51 reads out the detection range corresponding to the size of the conveyance object from the detection range information stored in the NVRAM 57, and sets the detection range as a detection range used for edge detection (Step S102).

Next, the CPU 51 refers to the defect position information stored in the NVRAM 57 to determine whether the defect position is included in the detection range set at Step S102 (Step S103). If the defect position is included in the detection range (Yes at Step S103), the CPU 51 performs control for outputting a warning to the operator (Step S104), and ends the processing.

On the other hand, if the defect position is not included in the detection range (No at Step S103), the CPU 51 stands by until the edge detection timing is reached (No at Step S105). When the edge detection timing is reached (Yes at Step S105), the CPU 51 instructs the CIS control circuit 52 to start edge detection, and starts to drive the CIS 30 (Step S106).

Thereafter, when the CIS 30 outputs an analog signal representing a voltage corresponding to the quantity of light accumulated by each pixel of the light receiving unit 34, the comparator 55 binarizes the output from the CIS 30 by threshold comparison to be input to the detection circuit 56 as a digital signal (Step S107). The detection circuit 56 checks the digital signal input from the comparator 55 for each pixel, and detects the position of the pixel at which the value of the digital signal is switched (Step S108). The position of the pixel detected by the detection circuit 56 is notified to the CPU 51.

When the position of the pixel detected by the detection circuit 56 is notified, the CPU 51 determines whether the position of the pixel is within the detection range set at Step S102 (Step S109). If the position of the pixel detected by the detection circuit 56 is within the detection range (Yes at Step S109), the CPU 51 determines that the position of the pixel is the edge position in the width direction of the conveyance object, and notifies the system control circuit 40 of the position as the edge detection result (Step S110). On the other hand, if the position of the pixel detected by the detection circuit 56 is outside the detection range (No at Step S109), the CPU 51 determines that the position of the pixel is the defect position, and stores the defect position information in the NVRAM 57 (Step S111).

The CPU 51 repeats the processing from Step S109 to Step S111 until determination on the positions of all the pixels detected by the detection circuit 56 is ended (No at Step S112). If the determination on the positions of all the pixels detected by the detection circuit 56 is ended (Yes at Step S112), the CPU 51 ends the series of processing.

As described above in detail with specific examples, in the edge detection device 50 according to the embodiment, the CPU 51 reads out the detection range to be set corresponding to the size of the conveyance object from the NVRAM 57, and the position of the pixel detected by the detection circuit 56 within the detection range is determined to be the edge position in the width direction of the conveyance object. Accordingly, for example, when the conveyance object with a hole is being conveyed, the edge detection device 50 according to the embodiment can effectively prevent the edge portion of the hole from being erroneously detected as the edge position in the width direction, so that the edge position in the width direction of the conveyance object used for image formation can be detected with high accuracy.

The image forming apparatus 1 according to the embodiment includes the edge detection device 50 that detects the edge position in the width direction of the conveyance object used for image formation with high accuracy, so that the image forming apparatus 1 can perform image formation of high quality by adjusting the position at which the image is formed on the conveyance object corresponding to the edge position detected by the edge detection device 50.

The functions of the CPU 51 (the determination module, the warning module) in the edge detection device 50 according to the embodiment can be implemented when the CPU 51 reads out and executes a predetermined computer program stored in a program ROM or a hard disk drive (HDD) provided inside the image forming apparatus 1, for example. In this case, for example, the computer program can be embedded and provided in the program ROM and the like in advance. The computer program may be recorded and provided in a computer-readable recording medium such as a compact disc read only memory (CD-ROM), a flexible disk (FD), a compact disc recordable (CD-R), and a digital versatile disc (DVD), as an installable or executable file for the image forming apparatus 1. The computer program may be stored in a computer connected to a network such as the Internet and provided by being downloaded by the image forming apparatus 1 via the network. Furthermore, the computer program may be provided or distributed via a network such as the Internet.

The functions of the CPU 51 (the determination module, the warning module) in the edge detection device 50 according to the embodiment can also be implemented using dedicated hardware such as an application specific integrated circuit (ASIC) and a field-programmable gate array (FPGA).

The specific embodiment of the present invention has been described above. However, the embodiment described above is merely an application example of the present invention. The present invention is not limited to the embodiment, and can be embodied by variously modifying or changing the embodiment without departing from the gist of the invention at an implementation phase.

Figure 7:
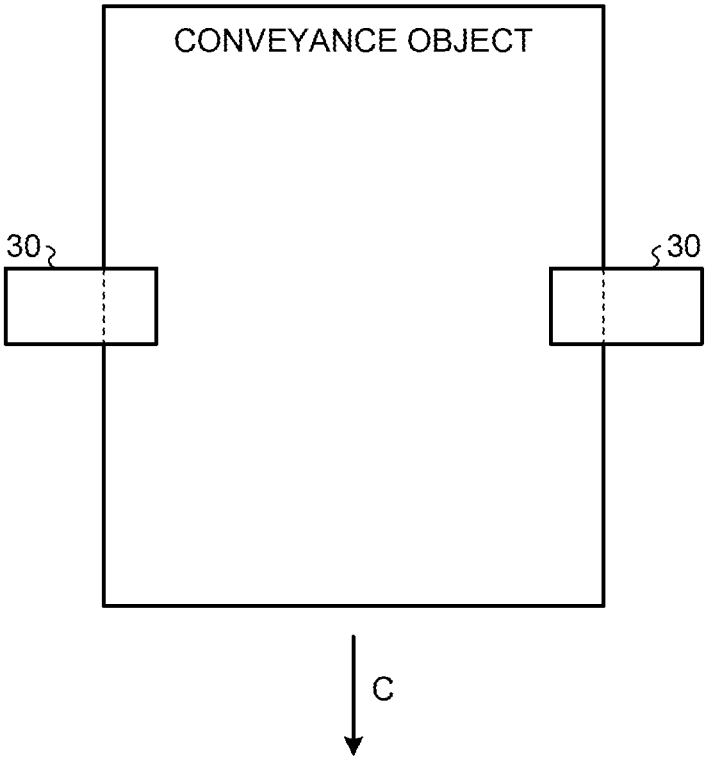
FIG. 7 is a diagram for explaining an arrangement example of the CIS for detecting edge positions of both ends in a width direction of a conveyance object.

For example, in the above embodiment, the edge position in the width direction of the conveyance object detected by the edge detection device 50 is used for adjusting the position at which the image is formed on the conveyance object. However, applications of the edge position detected by the edge detection device 50 are not limited thereto. The edge position may be utilized for other applications. For example, when the edge detection device 50 detects edge positions at both ends in the width direction of the conveyance object, the size in the width direction of the conveyance object in a case of printing the back surface in double-side printing can be detected. In this case, as illustrated in FIG. 7 for example, the edge detection device 50 includes two CISs 30 corresponding to both ends in the width direction of the conveyance object. Alternatively, the edge detection device 50 may include a long CIS 30 that is longer than the conveyance object of the maximum size that can be supported by the image forming apparatus 1.

In a case of printing the back surface in double-side printing, the size in the width direction of the conveyance object may be reduced as compared with that at the time when the front surface is printed due to heating by the fixing device 10 when the front surface is printed. In such a case, the edge detection device 50 detects the edge positions at both ends in the width direction of the conveyance object, and obtains a shrinkage ratio of the conveyance object based on a difference in the size in the width direction of the conveyance object between the time when the front surface is printed and the time when the back surface is printed. By adjusting the size of the image at the time when the back surface is printed in accordance with the shrinkage ratio of the conveyance object, misregistration between the front surface and the back surface of the image can be prevented.

The above embodiment describes the image forming apparatus 1 that performs printing using the electrophotographic system as an example of the image forming apparatus to which the present invention is applied. Alternatively, for example, the present invention can also be effectively applied to an image forming apparatus using another system such as an image forming apparatus that performs printing using an inkjet system. In the above embodiment, exemplified is the image forming apparatus 1 configured as a single device. Alternatively, for example, the present invention can also be effectively applied to an image forming apparatus (image forming system) configured by connecting a plurality of units such as a sheet feeding unit, a main body unit, and a postprocessing unit.

As an example of the edge detection device to which the present invention is applied, the above embodiment describes the edge detection device 50 configured to detect the edge position in the width direction of the conveyance object conveyed from the registration roller 15 of the image forming apparatus 1 to the secondary transfer position. However, the embodiment is not limited thereto. For example, when the CIS 30 is arranged in a conveyance path through which a conveyance object on which an image is formed by the image forming apparatus or a conveyance object on which no image is formed is conveyed to a postprocessing device, the edge detection device 50 including the CIS 30 can detect the edge position in the width direction of the conveyance object with a hole conveyed to the postprocessing device with high accuracy. By adjusting the position of the conveyance object based on the detected edge position, the conveyance object can be correctly conveyed to the postprocessing device, and postprocessing can be performed on the conveyance object with high accuracy.

According to exemplary embodiments of the present invention, the edge position in the width direction of the conveyance object can be detected with high accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An edge detection device for detecting an edge position in a width direction orthogonal to a conveying direction of a conveyance object, the edge detection device comprising:

a photoelectric conversion module arranged in a conveyance path of the conveyance object and including a plurality of photoelectric conversion elements aligned along the width direction;

a binarization module configured to binarize an output from each of the photoelectric conversion elements by threshold comparison;

a detection module configured to detect a position of the photoelectric conversion element at which a binarized value is switched;

a storage configured to store therein a detection range as a range used for edge detection among the photoelectric conversion elements for each size of the conveyance object; and a determination module configured to read out the detection range corresponding to the size of the conveyance object from the storage, and to determine whether the detected position is included within the read detection range, wherein in response to the detected position being within the read detection range, the determination module determines the detected position to be the edge position in the width direction of the conveyance object, and in response to the detected position being outside the read detection range, the determination module determines the detected position to be a defect position to which a foreign substance adheres.

2. The edge detection device according to claim 1, wherein the determination module determines the detected position to be the defect position in response to the detected position being outside the read detection range and the conveyance object not passing through the detected position.

3. The edge detection device according to claim 1, wherein the determination module is further configured to store the detected position of the photoelectric conversion element determined to be the defect position in the storage as defect position information.

4. The edge detection device according to claim 3, further comprising:

a warning module configured to refer to the defect position information stored in the storage to determine whether the defect position is included in a new detection range set in response to changing the size of the conveyance object, and to perform control for outputting a warning to an operator instructing the operator to clean the photoelectric conversion module in response to the defect position being included within the new detection range.

5. The edge detection device according to claim 1, wherein the detection range is a range having a size in the width direction centered around a reference position that is a position through which an edge in the width direction of the conveyance object passes with respect to the photoelectric conversion module, and the reference position varies depending on the size of the conveyance object.

6. An image forming apparatus comprising the edge detection device according to claim 1.

7. The image forming apparatus according to claim 6, further comprising:

a system control circuit configured to receive the edge position from the determination module, calculate a shift amount between the edge position and a reference position, and drive a shift roller arranged in the conveyance path of the conveyance object to shift a position of the conveyance object in the width direction based on the shift amount, wherein a position at which an image is formed on the conveyance object is adjusted corresponding to the edge position.

8. The image forming apparatus according to claim 6, further comprising:

an operation module configured to receive an operation made by an operator for setting the detection range, wherein the operation comprises one of, changing the read detection range, the read detection range being a default detection range corresponding to the size of the conveyance object, in response to a position of a hole in the conveyance object being close to the edge in the width direction and overlapping with the default detection range, such that the position of the hole in the conveyance object does not overlap with the changed detection range, or setting a custom detection range corresponding to a custom-sized conveyance object having a size that cannot be recognized by the determination module or specified by the operator, and the determination module is further configured to determine, upon the operation module receiving the operation from the operator, whether the detected position is included within the changed detection range or the custom detection range, wherein in response to the detected position being within the changed detection range or the custom detection range, the determination module determines the detected position to be the edge position in the width direction of the conveyance object, and in response to the detected position being outside the changed detection range or the custom detection range, the determination module determines the detected position to be the defect position.

9. An edge detection method executed by an edge detection device for detecting an edge position in a width direction orthogonal to a conveying direction of a conveyance object, the edge detection device including:

a photoelectric conversion module arranged in a conveyance path of the conveyance object and including a plurality of photoelectric conversion elements aligned along the width direction; and a storage configured to store therein a detection range as a range used for edge detection among the photoelectric conversion elements for each size of the conveyance object, and the edge detection method comprising:

binarizing an output from each of the photoelectric conversion elements by threshold comparison;

detecting a position of the photoelectric conversion element at which a binarized value is switched;

reading out the detection range corresponding to the size of the conveyance object from the storage; and determining whether the detected position is included within the read detection range, including determining the detected position to be the edge position in the width direction of the conveyance object in response to the detected position being within the read detection range, and determining the detected position to be a defect position to which a foreign substance adheres in response to the detected position being outside the read detection range.

10. The edge detection method according to claim 9, further comprising determining the detected position to be the defect position in response to the detected position being outside the read detection range and the conveyance object not passing through the detected position.

11. The edge detection method according to claim 9, further comprising storing the detected position of the photoelectric conversion element determined to be the defect position in the storage as defect position information.

12. The edge detection method according to claim 11, further comprising:

referring to the defect position information stored in the storage to determine whether the defect position is included in a new detection range set in response to changing the size of the conveyance object, and performing control for outputting a warning to an operator instructing the operator to clean the photoelectric conversion module in response to the defect position being included within the new detection range.

13. The edge detection method according to claim 9, wherein the detection range is a range having a size in the width direction centered around a reference position that is a position through which an edge in the width direction of the conveyance object passes with respect to the photoelectric conversion module, and the reference position varies depending on the size of the conveyance object.

14. The edge detection method according to claim 9, further comprising:

receiving an operation made by an operator for setting the detection range, wherein the operation comprises one of, changing the read detection range, the read detection range being a default detection range corresponding to the size of the conveyance object, in response to a position of a hole in the conveyance object being close to the edge in the width direction and overlapping with the default detection range, such that the position of the hole in the conveyance object does not overlap with the changed detection range, or setting a custom detection range corresponding to a custom-sized conveyance object having a size that cannot be recognized by the edge detection device or specified by the operator, and determining, upon receiving the operation from the operator, whether the detected position is included within the changed detection range or the custom detection range, including determining the detected position to be the edge position in the width direction of the conveyance object in response to the detected position being within the changed detection range or the custom detection range, and determining the detected position to be the defect position in response to the detected position being outside the changed detection range or the custom detection range.

15. An edge detection device for detecting an edge position in a width direction orthogonal to a conveying direction of a conveyance object, the edge detection device comprising:

a photoelectric conversion module arranged in a conveyance path of the conveyance object and including a plurality of photoelectric conversion elements aligned along the width direction;

a binarization module configured to binarize an output from each of the photoelectric conversion elements by threshold comparison;

a detection module configured to detect a position of the photoelectric conversion element at which a binarized value is switched;

a storage configured to store therein detection range information used for edge detection among the photoelectric conversion elements, wherein the detection range information defines, for each size of the conveyance object, a detection range having a size in the width direction centered around a reference position, wherein the reference position is a position of the photoelectric conversion element at a time when an edge in the width direction of the conveyance object passes through the photoelectric conversion module; and a determination module configured to read out the detection range corresponding to the size of the conveyance object from among the detection range information stored in the storage, and to determine whether the detected position is included within the read detection range, wherein the determination module determines the detected position to be the edge position in the width direction of the conveyance object in response to the detected position being within the read detection range, and the determination module determines the detected position to be a defect position in response to the detected position being outside the read detection range.

16. The edge detection device according to claim 15, wherein the defect position corresponds to a position of the photoelectric conversion element to which a foreign substance adheres.

* * * * *